US007213714B2

(12) United States Patent
Baker

(10) Patent No.: US 7,213,714 B2
(45) Date of Patent: May 8, 2007

(54) SLACK PULLING CARRIAGE FOR LOGGING OPERATIONS

(76) Inventor: Scotty Baker, 62500 Commerce Rd., La Grande, OR (US) 97850

( * ) Notice: Subject to any disclaimer, the term of this patent is extended or adjusted under 35 U.S.C. 154(b) by 251 days.

(21) Appl. No.: 10/661,856

(22) Filed: Sep. 11, 2003

(65) Prior Publication Data

US 2004/0129662 A1 Jul. 8, 2004

Related U.S. Application Data

(60) Provisional application No. 60/410,386, filed on Sep. 11, 2002.

(51) Int. Cl.
*B66B 21/00* (2006.01)

(52) U.S. Cl. ..... 212/89; 212/87

(58) Field of Classification Search ..... 212/87, 212/89

See application file for complete search history.

(56) References Cited

U.S. PATENT DOCUMENTS 4,109,799 A * 8/1978 Munn ..... 212/83
4,238,038 A * 12/1980 Fikse et al. ..... 212/89
4,454,951 A 6/1984 Kuehn ..... 212/89
4,456,131 A 6/1984 Kuehn ..... 212/97
4,515,281 A 5/1985 Maki ..... 212/76
4,523,892 A * 6/1985 Mitchell et al. ..... 417/34
4,687,109 A 8/1987 Davis ..... 212/76
5,020,443 A 6/1991 Gauthier ..... 104/230
5,975,319 A * 11/1999 Carlile, Jr. ..... 212/99

* cited by examiner

*Primary Examiner*—Thomas J Brahan
(74) *Attorney, Agent, or Firm*—Pedersen & Co., PLLC; Ken J. Pedersen; Barbara S. Pedersen

(57) ABSTRACT

The present invention involves a carriage of the type commonly used in skyline logging operations. The invention facilitates moving logs along a suspended skyline by means of a hoisting system built into the carriage comprised of a radio controlled electronics system, an internal combustion power plant, proportional controlled hydraulically driven skidline sheave, a skidline clamp and skyline clamp. A novel method of pump control keeps the internal combustion engine operating within its power band. The volume output of the pump is controlled by engine RPM to adjust the pump's load on the engine. Combined operation of the various controls on the carriage, in conjunction with the controlled operations of the yarder winch at the end of the skyline result in a system well suited for efficient logging operation. The choker/setter (ground crew) and the yarder are able to remotely control the carriage operation as a team. The carriage controls of the present invention are primarily hydraulic, actuated by means of electrical solenoid valves.

8 Claims, 9 Drawing Sheets

SLACK PULLING CARRIAGE FOR LOGGING OPERATIONS

DESCRIPTION

This application claims priority of Provisional Application Ser. No. 60/410,386, filed Sep. 11, 2002, and entitled Slack Pulling Carriage for Logging Operations, which is hereby incorporated by reference.

BACKGROUND OF THE INVENTION

1. Field of the Invention

This invention relates generally to logging equipment, more particularly to a radio-controlled, slack-pulling skyline carriage.

2. Related Art

In reviewing the body of patents and commercial products that incorporate controls to skyline carriage type vehicles, none of the information reveals a similar closed-loop method of controlling the position of the carriage, nor providing controls that facilitate the types of operations of which this invention is capable.

A distinct advantage of the closed-loop operation method of the present invention lies in its ability to control the effective load and speed (RPM) of the driving engine under differing conditions to best make use of its engine braking, power and torque characteristics. As will be made evident in the description that follows, based upon monitoring engine RPM, the control system proportionally controls the main hydraulic pump output volume to keep the engine running within its optimal RPM band. Due to the utility of the closed-loop control system, as set forth in the present invention, the general carriage operation in timber harvesting via remote control is far easier compared to other carriages presently known in the art.

In earlier inventions, a variety of skyline carriages were patented; each of them different in various key aspects from the present invention. Gauthier in U.S. Pat. No. 5,020,443 teaches about a radio-controlled carriage that houses an internal combustion motor and a drive system that provides a driving method and hoist method that is fundamentally different than the current invention in that it has a driven set of mainline pulleys, whereas the mainline pulleys of the present invention are free rolling.

In U.S. Pat. No. 4,687,109, Davis describes a carriage that uses batteries, motors and a skyline powered recharging method to move and brake the carriage. This approach, versus the current invention, is fundamentally different in providing only a limited ability to pull large loads with the skidline. It relies upon an electrical power source that charges/stores energy from movement of the carriage along the skyline.

In U.S. Pat. No. 4,515,281, Maki teaches about a system whereby the movement of the carriage along the skyline drives two on-board hydraulic pumps and a large accumulator that power the skidline sheave. This approach requires multiple pumps, clutches and mechanisms to realize motive power for the skidline sheave, and relies on the energy that is provided by movement of the carriage along the skyline. There are multiple shortcomings to the invention as it is described, all of which are overcome with the present invention. The primary problem with Maki's invention is its reliance upon carriage motion for operation of the skidline sheave. Pump selection and drive ratios are problematic in that the slope of the cable, which varies from site to site, must be considered in selecting the configuration of the pump drivetrain components.

As will be seen in the description that follows, the present invention is a more efficient and useful device than all prior art.

SUMMARY OF THE INVENTION

While a traditional concern of any logging operation is the efficient transportation of felled timber from a forest to processing plants, modem logging planners are also concerned with minimizing safety hazards and environmental damage resulting from such operations.

After timber is harvested, the resulting logs are transported to a landing. A landing is a generally level area, situated near a logging road, from which logs are loaded on trucks and hauled to processing plants. The act or process of conveying logs to a landing is known as "yarding."

When harvesting steep slopes or hauling over longer distances, a skyline system is often employed, in which a cable known as a skyline is stretched taut between two spars to extend over sloped terrain. A carriage equipped with grooved wheels rides on the skyline to carry logs to a landing positioned near one of the spars. A second cable, known as the skidline, extends from the uphill spar to the carriage. The skidline is reeled in to pull the carriage uphill and paid out as the carriage moves downhill due to gravity.

To operate a skyline system, the carriage is lowered to a desired location on the skyline and secured in place. In the present invention, the carriage is secured with a hydraulically operated skyline clamp. Chokers or grapple hooks are lowered from the carriage and attached to nearby logs. Once the logs are attached to the chokers or grapple hooks, they are raised up to the carriage and the carriage is moved either uphill or downhill to a landing, where the logs are lowered and released.

The skyline is usually elevated at least one end. When logging a concave slope, for example, the uphill spar is normally elevated by a portable tower, while the downhill spar is secured to a tree trunk or the like. Elevating the skyline allows the logs to be transported to the landing without dragging them on the ground. This procedure makes it easier to pass over ground obstacles and lessens environmental damage by minimizing soil disruption caused by dragging the logs over the ground.

Radio-controlled, hydraulically driven components, such as the skyline clamp, skidline clamp and skidline sheave, are advantageous because they allow log riggers to quickly and accurately control carriage functions. This is not only more efficient, but safer as well, as a rigging crew need not signal a distant operator to halt carriage operations in case of an emergency.

There is a need for a skyline carriage system with a safe and reliable means of control that has the ability to pull slack as the carriage descends and to also allow the simultaneous lowering of the payload as the carriage comes into the landing.

It is an object of the present invention to control the diesel engine RPM by monitoring that same RPM, calculating the hydraulic pump stroke volume at a periodic re-calculation rate, and controlling the pump either electrically or through electro-hydraulic means to provide the calculated volume. Since a variation in the pump stroke volume is proportional to the change in engine power output, one is able to effectively control the operation of the engine in a closed-loop manner. More efficient operation is realized through this control method, whereby the operator can more easily manipulate a turn of logs. The resultant skyline carriage system provides a safe and reliable means of control that has the simultaneous ability to pull slack, (to drop the skidline cable end toward the ground,) as the carriage descends on the skyline, and to also allow simultaneous lowering of a payload as the carriage comes into the landing. This ability of the carriage to raise and lower the payload during movement along a skyline allows for the load to be picked-up and dropped-off more quickly, thereby decreasing in the cycle-time of logging operations and improving productivity.

The different embodiments, aspects, advantages and features of the present invention will be set forth in part in the description, and in part will come to those skilled in the art by reference to the following description of the invention and referenced drawings, or by practice of the invention.

DETAILED DESCRIPTION OF THE INVENTION

The present invention is typically contained within a skyline carriage that incorporates a self-contained internal combustion power plant which hydraulically drives either a skidline sheave, as found in a slack pulling type of carriage, or a driven drum, as found in a drum type of carriage. In either type of carriage, the present invention performs the function of regulation of the rotational speed (RPM) of the carriage's internal combustion engine so as to maintain its operation within a specific range, or power band. In each type of carriage, electrical and hydraulic controls are operated by remotely controlled electronics, whereby the carriage operator communicates by way of radio telecommunication. The present invention is useful for more precisely controlling carriage operation, improving safety and reducing cycle-times in logging operations. It is an object of the present invention to provide a means of raising a turn of logs or other payload from a first source location and transporting that load above the ground, suspended beneath a taut skyline, to a destination location.

Figure 1:
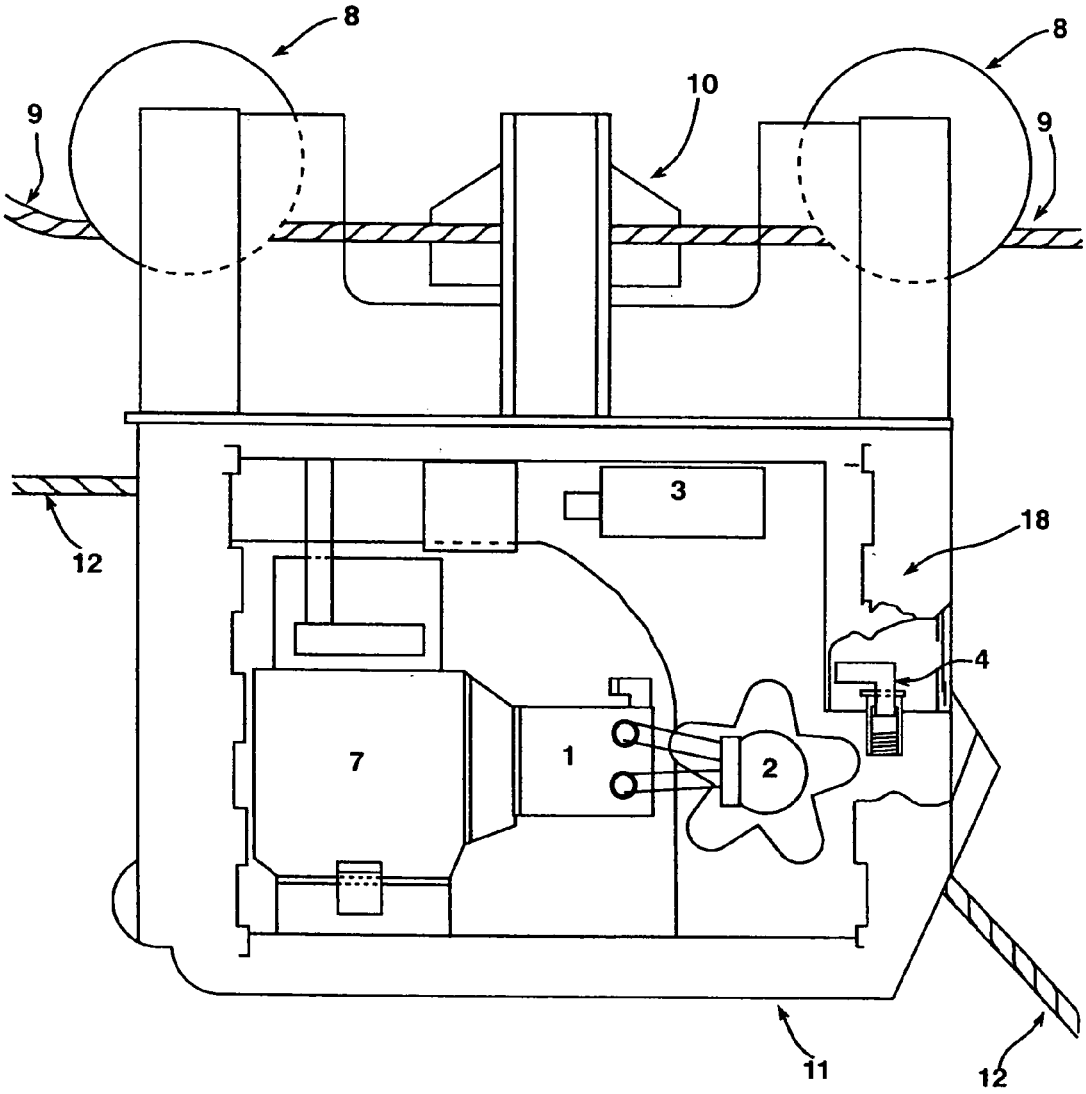
FIG. 1 (Prior Art)
FIG. 1 is a schematic diagram showing one side of a typical slack-pulling carriage with the side access cover removed.
Figure 7:
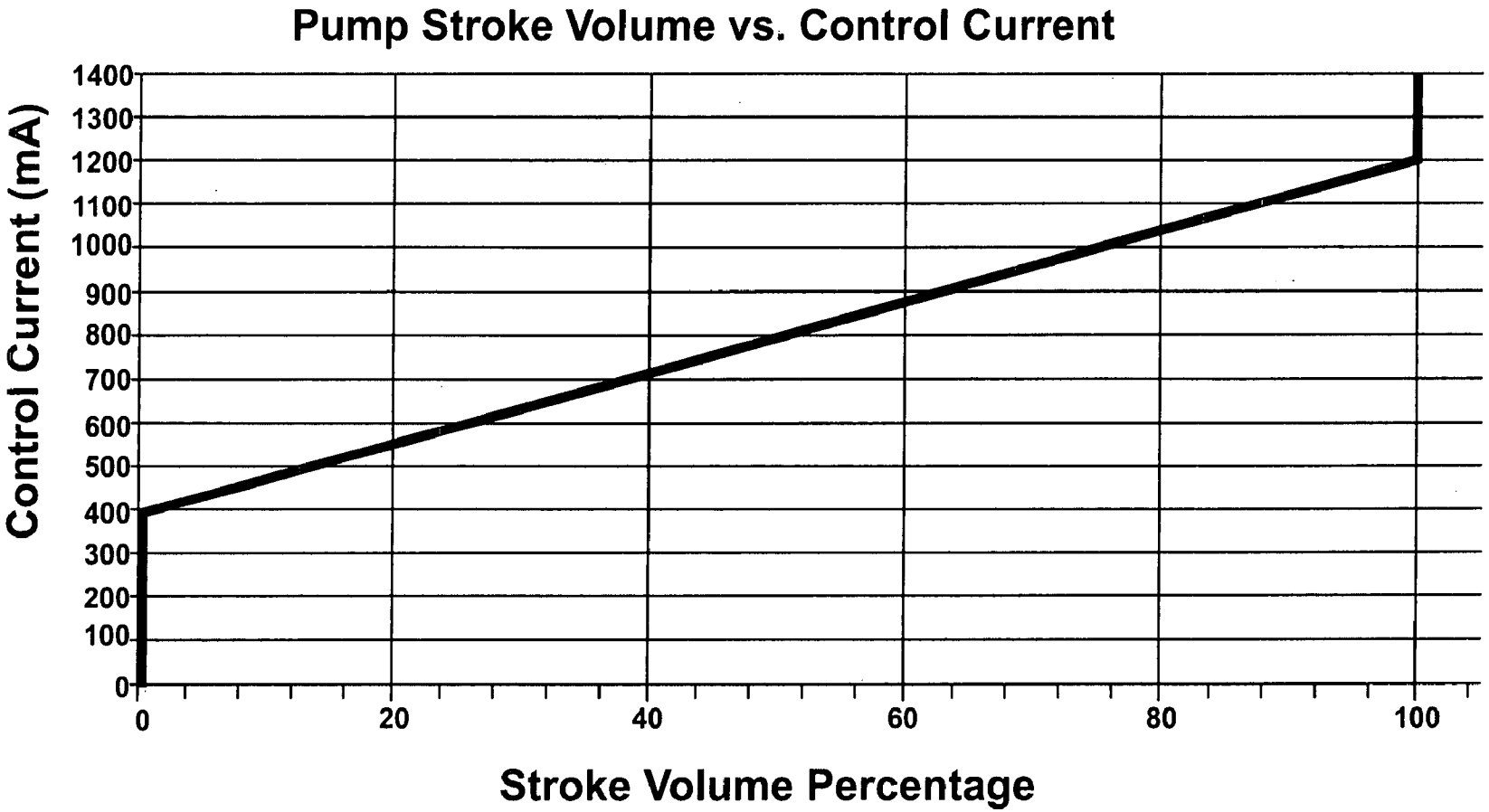
FIG. 7 is a graph showing the pump stroke volume versus control current of a preferred embodiment of the present invention.

FIG. 1 is a schematic pictorial diagram showing one side of a typical slack pulling carriage 11 with the side access cover removed. The main power to drive the hydraulic controls within the carriage 11 is provided by the internal combustion engine 7. The engine, in the preferred embodiment, is connected mechanically by rotating shaft to main hydraulic pump 1, (such as a Mannesman Rexroth AA4VG, Series 3 EP, or a Sauer Sundstrand Series 90), which have an electrical control capability that allows the stroke volume to be varied proportionally from 0% to 100% of full capacity via electrical input signal. Control of hydraulic pump volume (volume of fluid pumped per revolution) is achieved by varying the piston stroke length, which in the preferred embodiment is electro-hydraulically controlled within the workings of the pump. Piston stroke faithfully follows the aforementioned electrical input signal. Other off-the-shelf hydraulic pumps allow alternate methods of control of stroke volume via hydraulic pilot pressure control or via position of a mechanical lever. As mentioned, the preferred embodiment uses an electrical proportional control, whereby the control signal is a DC current that varies between 400 and 1200 milliamperes, as shown in the graph of FIG. 7. If, for example, the current is less than 200 milliamperes then the pump stroke will remain at 0%, and likewise, if the current exceeds 1200 milliamperes, the pump stroke will remain at 100% of full stroke volume.

A typical pump as required for the present invention at full stroke delivers 28 cc per revolution. Pump 1 is directly connected by flexible hydraulic hoses 35, 36 to hydraulic motor 2. Also visible in FIG. 1 is the mounting location of radio receiver 3, hydraulic fluid tank 18, skyline pulleys 8, and skyline clamp 10. Within the hydraulic tank 18 is a pick-up tube 4, which supplies hydraulic fluid to the hydraulic drive and control system of the carriage. Pick-up tube 4 swivels so that when carriage 11 is operating at extreme angles hydraulic fluid pick-up is facilitated.

The purpose of skyline clamp 10 is to stop the carriage from its otherwise free rolling movement upon the pulleys 8 of the skyline cable 9, especially when picking-up or unloading a turn of logs. Also depicted in FIG. 1 is the skidline cable 12 where it enters from the left in the drawing and exists at the lower right of the carriage 11.

Figure 2:
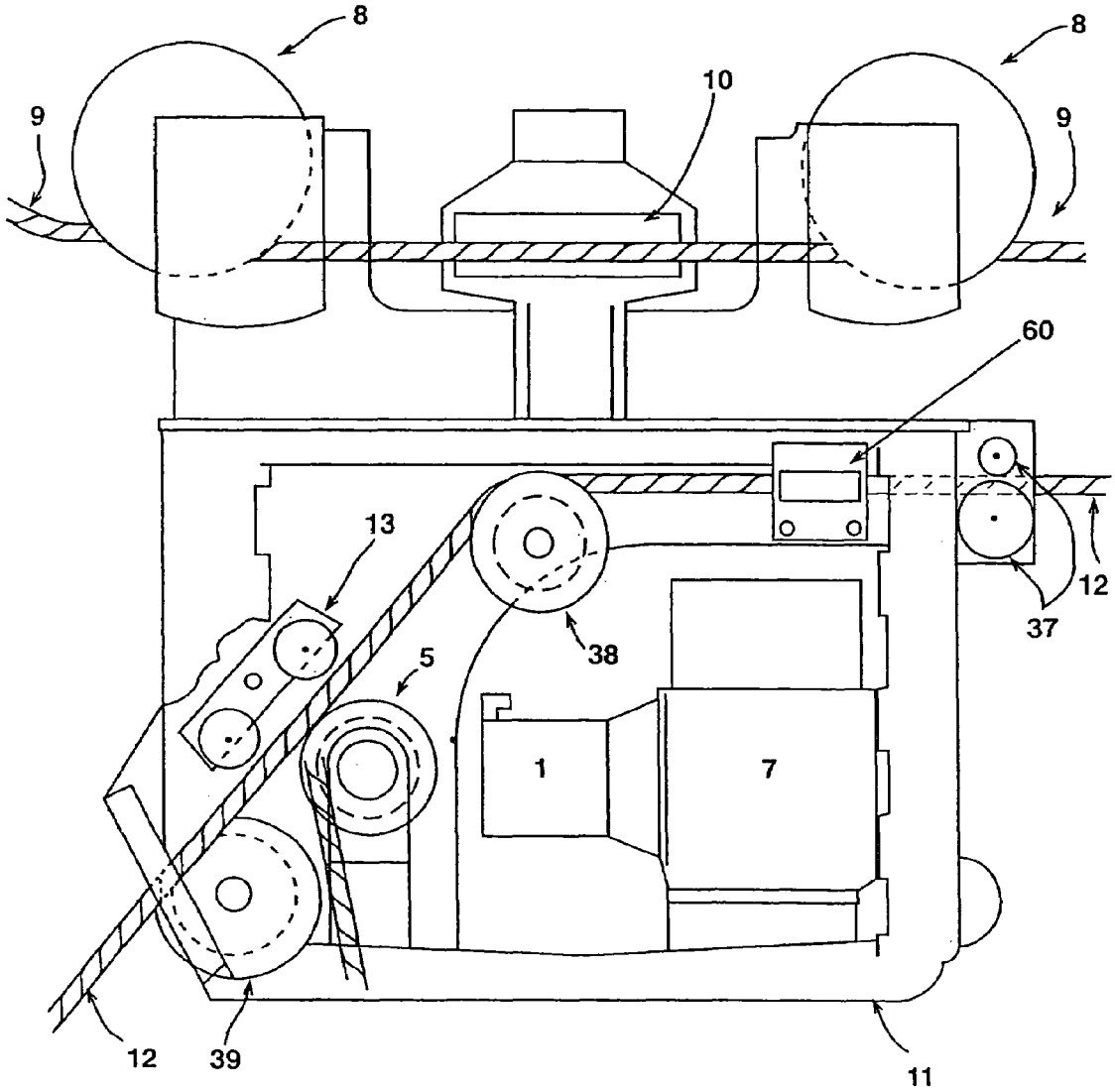
FIG. 2 (Prior Art)
FIG. 2 is a schematic diagram showing the other side of the slack-pulling carriage depicted in FIG. 1 with the other side access cover removed.

FIG. 2 is a schematic pictorial diagram showing the other side of a typical slack pulling carriage 11 like the one depicted in FIG. 1 with the side access cover removed. Visible from this side of the carriage 11, as on the other side shown in FIG. 1, are the internal combustion engine 7, main hydraulic pump 1, skyline pulleys 8, skyline clamp 10, and skyline cable 9. In this view, it can be seen that the skidline cable 12 enters through the top skidline pulleys 37, passes through skidline clamp 60, is guided through the center skidline pulley 38, through the slack-puller sheave 5 and sheave pressure roller 13, where the cable exits the carriage 11 guided via bottom skidline pulley 39.

Figure 3:
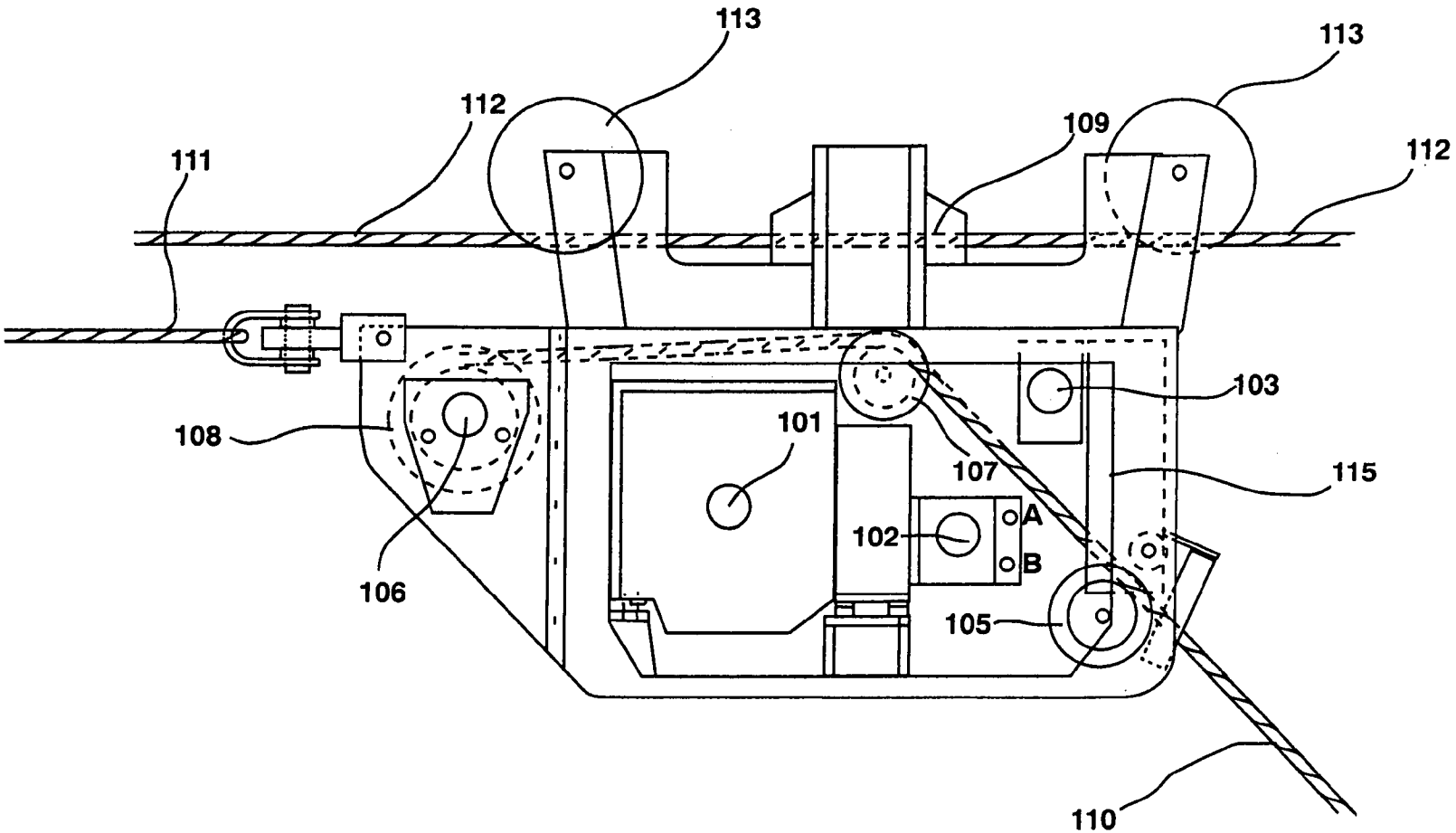
FIG. 3 (Prior Art)
FIG. 3 is a schematic diagram showing one side of a typical drum carriage with the side access cover removed.

FIG. 3 is a schematic pictorial diagram showing one side of a typical drum carriage with the side access cover removed. Carriage power is provided by internal combustion engine 101, which is coupled by a driveshaft to a variable displacement piston pump 102 that has a proportional electric control. Pump 102 is connected in a closed loop via two flexible hydraulic hoses, pressure side and return side, to hydraulic motor 106. Also visible for general reference in FIG. 3 are the following components: radio receiver 103, skidline sheave and rollers 105, drum line guide sheave 107, cable drum with planetary gears 108, skyline clamp 109, skidline cable 110, mainline cable 111, skyline cable 112, skyline sheaves 113, and hydraulic tank 115.

Figure 4:
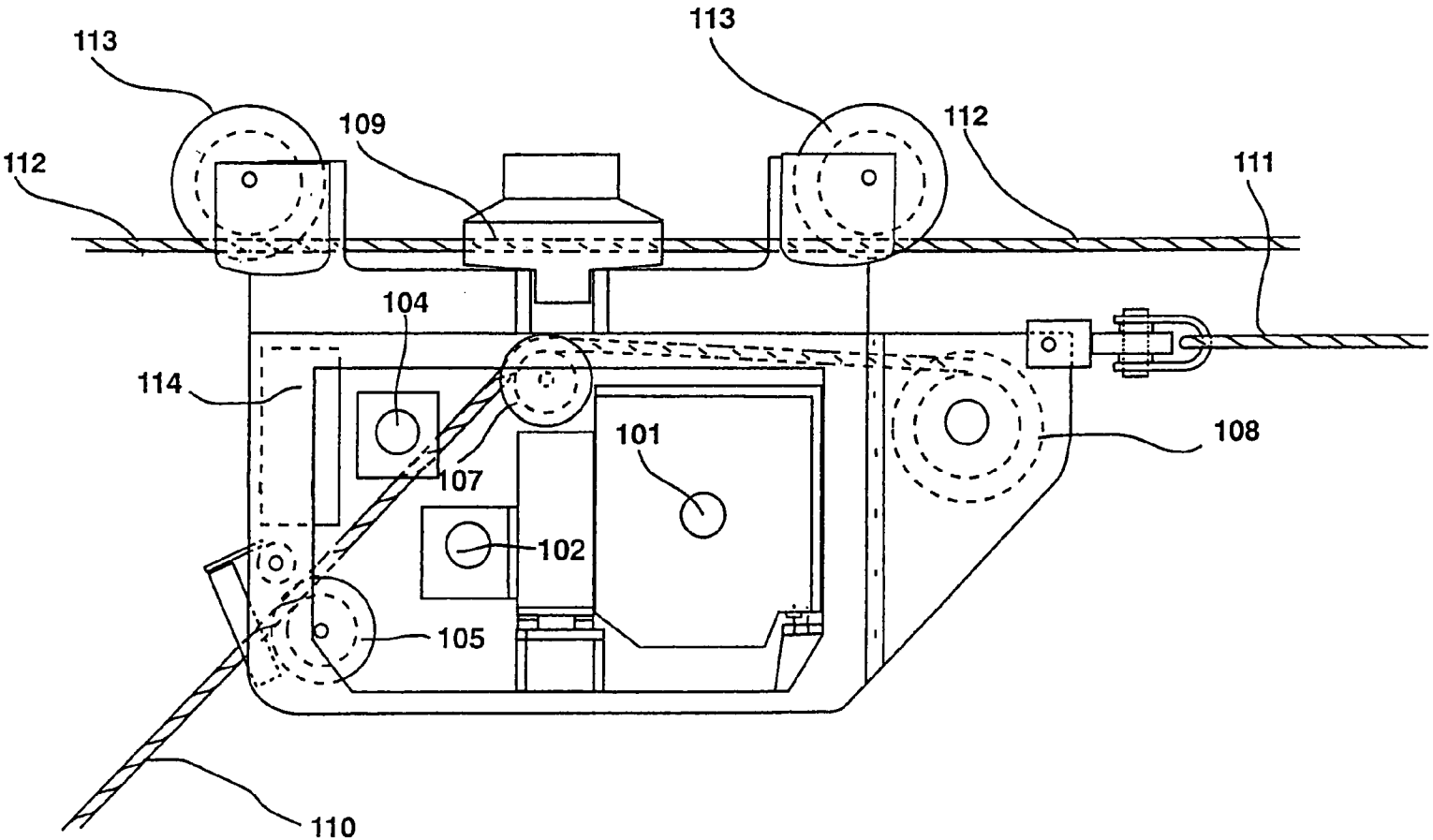
FIG. 4 (Prior Art)
FIG. 4 is a schematic diagram showing the other side of the drum carriage depicted in FIG. 3 with the other side access cover removed.

FIG. 4 is a schematic pictorial diagram showing the other side of a typical drum carriage 11 like the one depicted in FIG. 3 with the side access cover removed. What is shown, for general reference, are the opposite sides of the components listed for FIG. 3, above, and additionally are shown the electrical control box 104 and fuel tank 114. It should be noted that the componentry of a typical drum carriage that embodies the present invention are quite similar to those components of the slack pulling carriage as depicted in FIGS. 1 and 2, and as described in the preceding paragraphs. The main differences are a) the mainline in a drum carriage is anchored to the body of the carriage, and b) the skidline in a drum carriage does not pass through the carriage to act also as a mainline, but rather is wound onto and off of cable drum 108.

Figure 5:
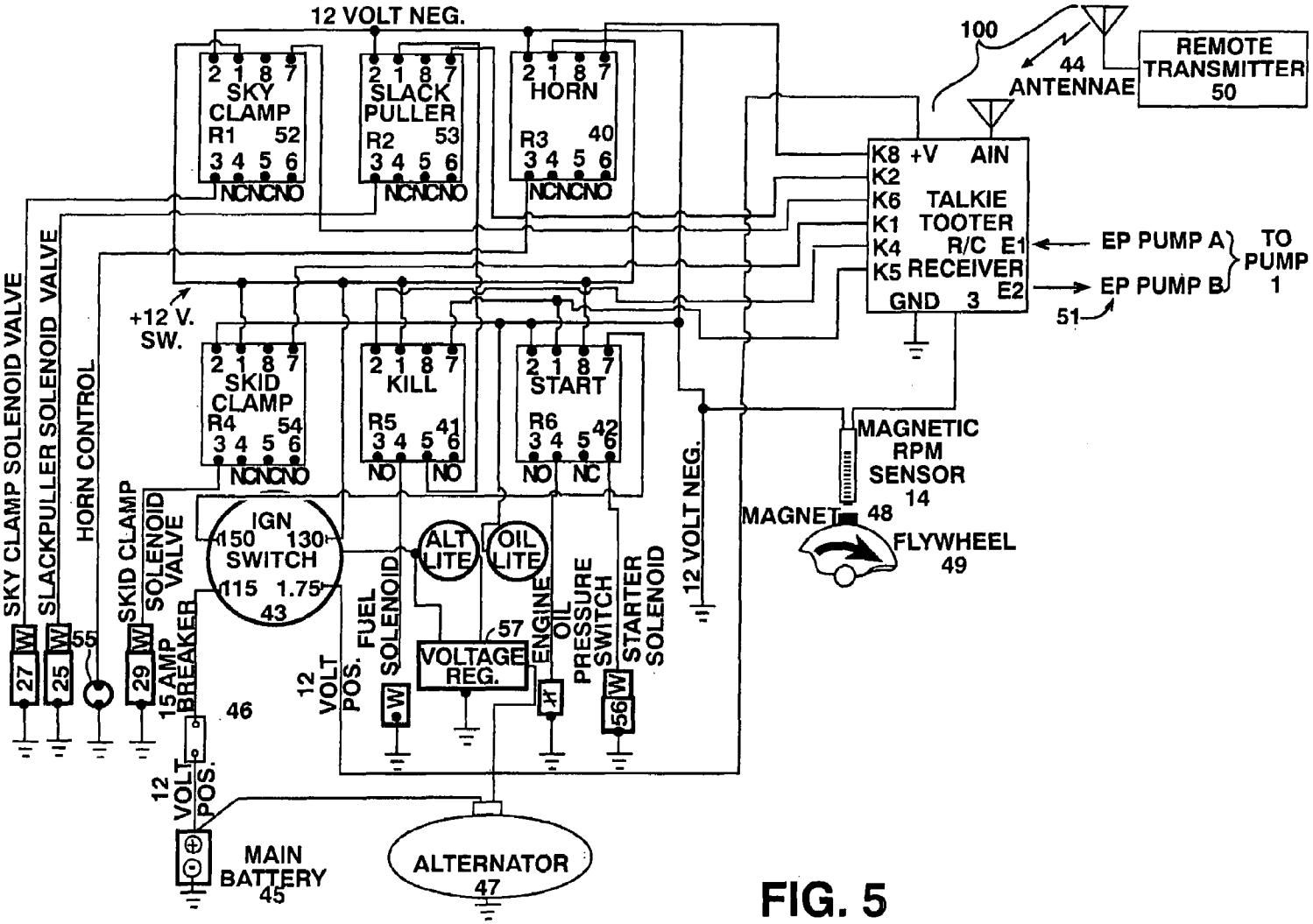
FIG. 5 is a schematic electrical diagram of a preferred embodiment of the present invention showing the electrical wiring connections.

FIG. 5 is a schematic electrical diagram of the preferred embodiment of the present invention showing the electrical wiring connections inside the carriage. The main battery 45, a standard automotive type lead-acid battery, supplies power for the system via circuit breaker 46 to the ignition switch. On ignition switch 43, power is applied to terminal 115. Start voltage is delivered to start relay 42 via switch terminal 150. All other system power is switched to terminals 130 and 175 of ignition switch 43. Alternator 47 is driven by belt coupling off of the engine and provides charging current to the battery 45, being regulated by voltage regulator 57.

The radio system 100 is preferably an industrial grade radio controller product manufactured by Rothenbuhler Engineering of Sedro Wooley, Wash. Receiver 3 receives a control signal from remote transmitter 50 via antennae 44. Switched contact control signals, labeled as Kn, where n=1 through 8 are provided as outputs from the receiver to the system being controlled. When controls are actuated by operator(s) on transmitter 50, signals are sent on the Kn control signal lines, which in turn control the operation of the carriage system relays R1 through R6. (40, 41, 42, 52, 53 and 54). These carriage system relays control the operation of the motor and hydraulic functions of the present invention. Relay R1 (52) controls the operation of the skyline clamp control solenoid valve 27. Relay R2 (53) controls the operation of the slack-puller pressure control solenoid valve 25. Relay R3 (40) controls the operation of horn 55. Relay R4 (54) controls the operation of the skidline clamp solenoid valve 29. Relay R5 (41) allows for remote controlled shutdown of the engine 7 fuel supply and system control. Start relay R6 (42) controls operation of the starter solenoid 56.

Another feature of the receiver 3 is the capability of reading the RPM sensor 14. Preferred magnetic RPM sensor 14 picks-up the engine rotation via a magnet 48 on engine flywheel 49. The receiver 3 interprets the engine 7 speed, based upon its operating mode and generates control signals E1 and E2 that drive the EP control lines 51 on the electrically proportional pump control of pump 1. In this embodiment, the radio 3 has a built-in profile of signal levels that it outputs on the E1 and E2 lines according to RPM and the operating mode of the system. Such a system allows for high and low speed motion of the skidline, for prevention of engine over-run and under-run conditions, and allows for a smooth, proportional ramping of pump volume in the transition zones. This allows the engine 7 to remain within its most efficient operating range during large load transitions.

Figure 6:
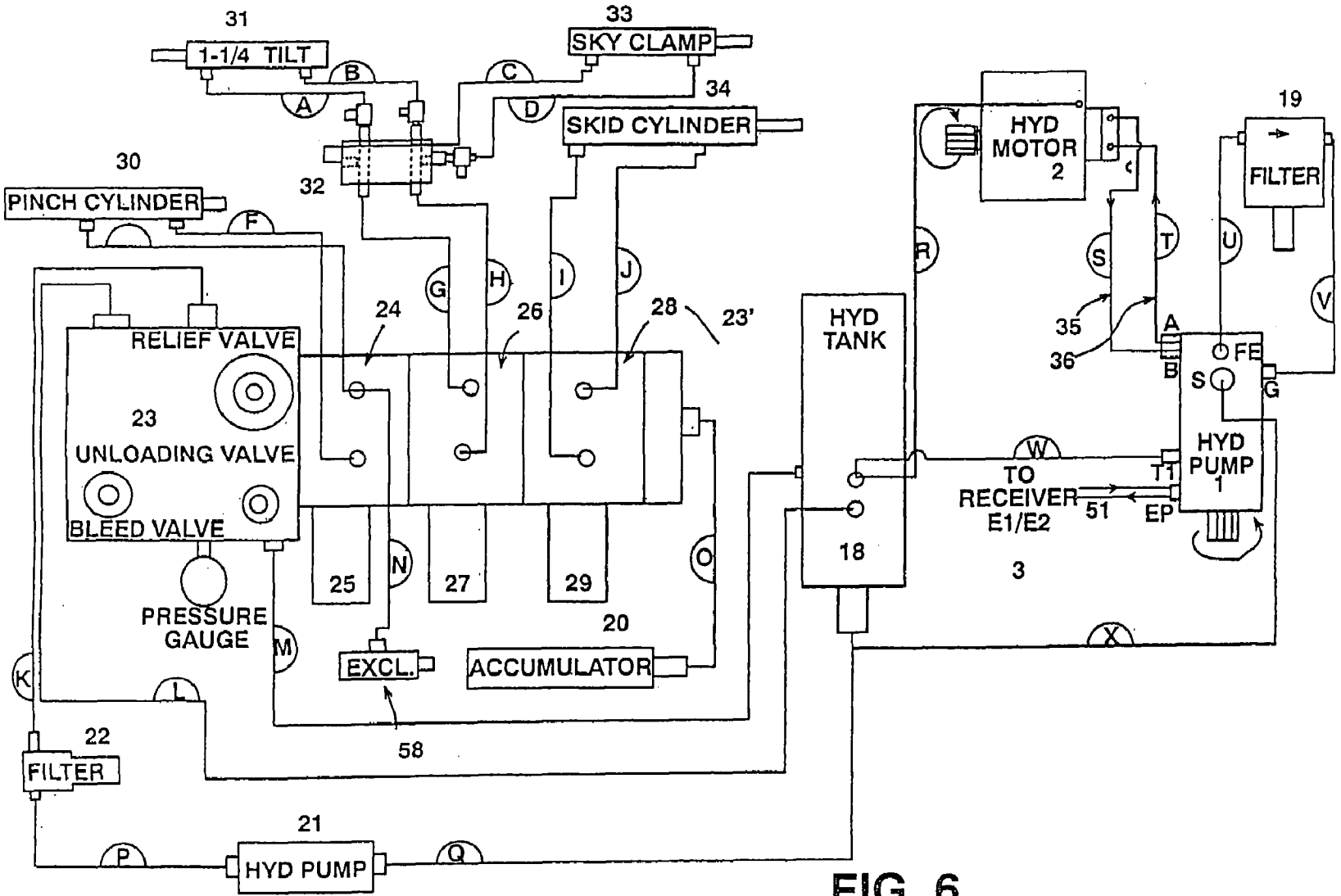
FIG. 6 is a schematic flow diagram of a preferred embodiment of the present invention showing hydraulic components and hydraulic interconnections.

FIG. 6 is a schematic flow diagram of the preferred embodiment of the present invention showing the various hydraulic components and hydraulic interconnections. These components comprise the means whereby control of the system via hydraulic actuators is achieved. The main drive of the system, pump 1 is shown with connections 35, 36 to motor 2. Pump 1 is connected mechanically to the crankshaft of engine 7, and it outputs hydraulic fluid to motor 2 via port A and line T (36). The fluid drives motor 2 and is returned in a closed-loop via line S (35). From the motor, line R is a case drain to recover any fluid that leaks internally in the motor back into hydraulic tank 18. Similarly, hydraulic line W returns fluid from case drain at Port T1 on pump 1 to tank 18. Port S on pump 1 is a charge pump suction line that is supplied with fluid as required from tank 18 via line X. A filter 19 is fed by pressurized hydraulic fluid via Port FE, and provides clean return fluid to the internals of pump 1 via return port G.

Also shown in FIG. 6 is a secondary hydraulic pump 21, which pulls hydraulic fluid from hydraulic tank 18, and pumps it through filter 22 into control pressure manifold 23. A hydraulic return line L sends fluid back to tank 18. Manifold 23 provides feed fluid to solenoid block 23' to the control section of the hydraulic system of the present invention. The controls are effected via control valves 24, 26, and 28, which are actuated/de-actuated by solenoids 25, 27, and 29, respectively.

When solenoid 25 is actuated, it allows control valve 24 to actuate pressure cylinder 30, which, in-turn, brings sheave pressure roller (pressure roller) assembly 13 into contact with the sheave roller and causes the cable to be grabbed securely in the rotating sheave, causing the skidline cable 12 to be pulled upward or downward through the carriage 11. Similarly, when solenoid 27 is actuated, it allows control valve 26 to actuate cylinders 31 and 33 via manifold 32. This actuation causes the skyline clamp assembly 10 to unclamp from skyline cable 9. In the same way, when solenoid 29 is actuated, it allows control valve 28 to actuate skidline cylinder 34, which un-clamps the skidline cable 12, to allow it to move. As a failsafe, the skidline clamp and skyline clamp are normally clamping the cables when they are de-actuated.

FIG. 7 is a graph showing the pump stroke volume versus control current of the preferred embodiment. The signals 51 that are sent by the receiver 3 to pump 1, control the pump piston stroke, and therefore volume output of pump 1 in the preferred embodiment. These signals form a current loop interface to the pump, where the driving current is a controlling signal which, by means of the typical operation of this type of commercially available pump, is proportional to the pump stroke volume. The transfer function that is embodied in the present invention is depicted in FIG. 7. As the current in the loop exceeds 400 mA, the pump begins to deliver more than zero volume per revolution, proportional to the current in the current loop 51, up to 100% volume of 1200 mA. The pump volume in the preferred embodiment of the present invention will vary proportionally from 0 to 100% output as the control current varies between 400 and 1200 mA. Below 400 and above 1200 mA, the pump will hold at the 0% and 100% stroke volume settings, respectively.

In a similar fashion, a hydraulically controlled pump could be substituted for the preferred electrically controlled pump. Pump 1 could alternately be of the type, such as the Mannesman Rexroth AA4VG Series 3 HD, that is designed to receive a hydraulic pilot pressure, proportional to the desired pump output volume, from 0 to 100%.

Figure 8:
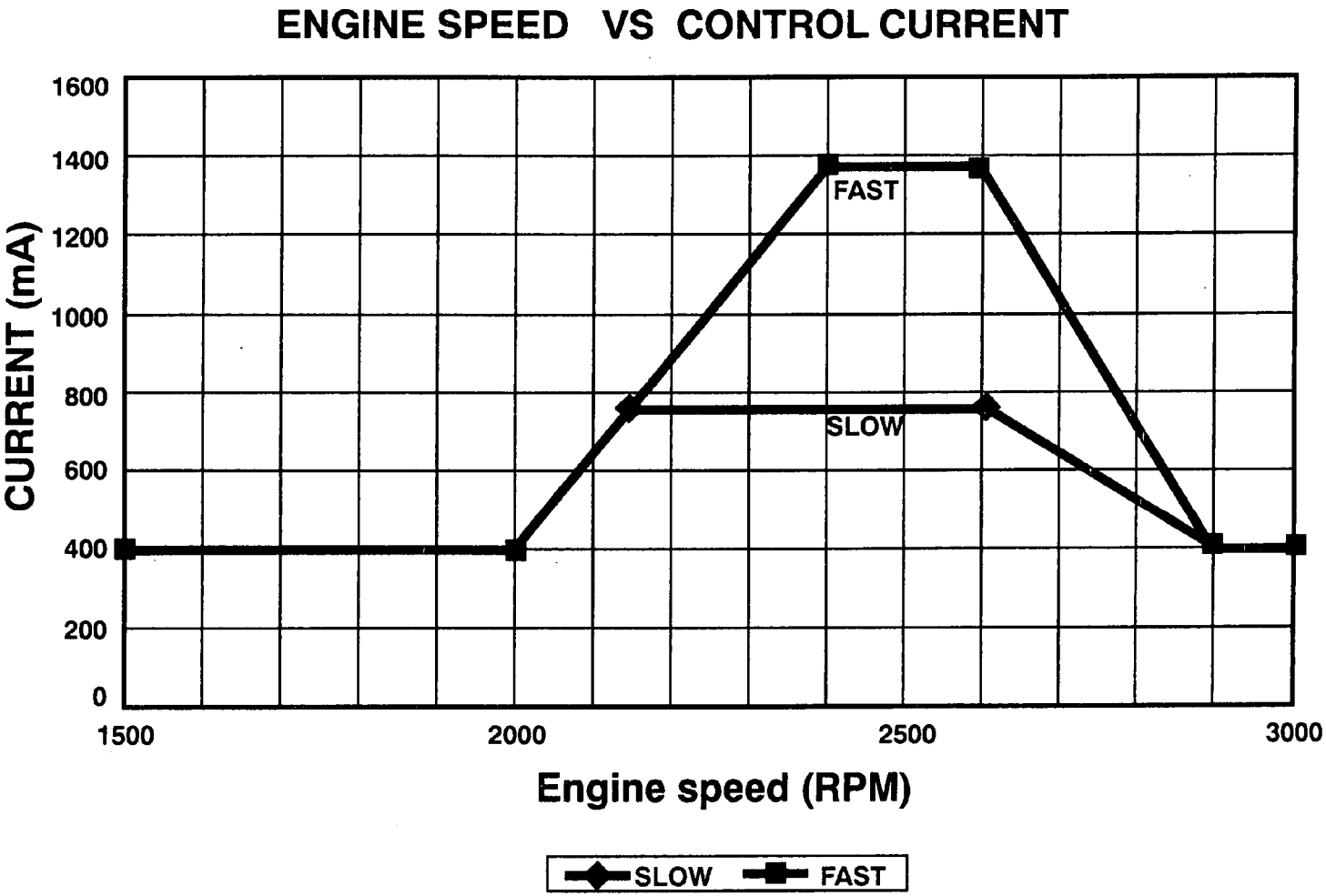
FIG. 8 is a graph showing the engine speed versus control current of a preferred embodiment of the present invention.

FIG. 8 is a graph showing the engine speed versus control current of the preferred embodiment. The controller circuit within the receiver maintains certain current loop settings on the pump control leads 51 based upon the engine RPM and mode, as depicted in the graph. The ramping functions in the graph have been shown to perform acceptably in actual testing. The slow and fast sheave speed settings and their respective ramping functions are implemented via electronic control within the receiver.

Figure 9:
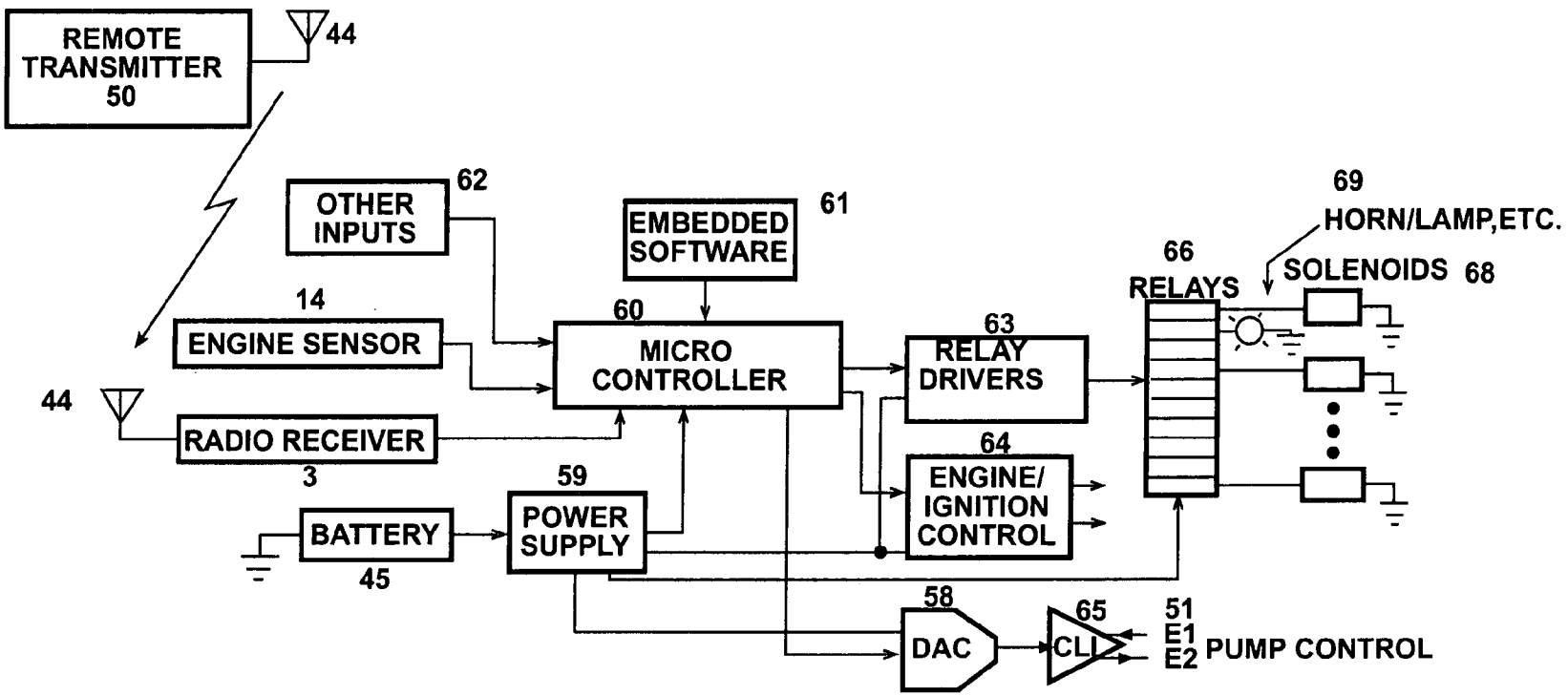
FIG. 9 is a schematic block electrical diagram of a microprocessor-based system of an alternate embodiment of the present invention.

FIG. 9 is a schematic block diagram of a microprocessor-based system of an alternate embodiment of the present invention, whereby a microcontroller 60 receives commands from the remote transmitter 50 via antennae 44. Engine RPM sensor 14 is connected directly to a digital input port on microcontroller 60. For proportional pump control, a Current Loop Interface (CLI) 65 is maintained via a Digital to Analog Converter (DAC) 58, which receives its signal from the microcontroller 60. The CLI 65 drives the pump proportional control leads 51. The CLI signal controls the stroke volume of the hydraulic pump, which directly controls sheave-pulling speed. The power supply 59 converts power supplied by battery 45 into regulated, filtered DC voltages as required by different circuits, such as relay drivers 63, engine ignition control 64, DAC 58 and microcontroller 60.

Other inputs 62 from signal lines such as tank levels, temperatures, oil pressure, etc. are conditioned and passed on to the microcontroller 60. The microcontroller controls the relays 66 by way of the relay current drivers 63. Solenoid valves 68, and horn, lamps, etc. 69 are controlled via relays 66. Engine and ignition control 64, such as start/kill, fuel shutoff, are programmatically controlled.

Embedded software program 61 is executed by microprocessor 60 to implement the operating system of the present invention. It contains tuning parameters, which allow the system to be adjusted, as required, for timing values, ramp functions, and other such algorithmic manipulations. The inventor foresees continual improvements through programmatic revision, continuing software refinement to further elevate the art of this invention, while not changing the system hardware.

The usefulness of the present invention is extensive, whereas other skyline carriages lack the control capabilities that are provided by the present invention. Engine and pump speed is finely controllable, the engine is kept within a narrow range of RPM, and reliability is achieved through combination of numerous programmatic, electrical and mechanical improvements.

The choice of monitoring the primary pump pressure and volume instead of or in addition to engine RPM, as described above, to achieve desirable pump stroke control are examples of other control system configurations that are feasible and could be included as functional equivalents in this invention. The preferred embodiment of the present invention monitors RPM and mode only, but alternate configurations could monitor combinations of other operating parameters in the system. Pump volume and pump pressure are examples of other such parameters that are useful in controlling the system.

What is claimed is:

1. A remotely controlled slack pulling carriage for movement along a suspended cable which comprises:

a chassis containing an internal combustion power plant, and an electrical system which comprises a battery, electric starter and alternator for starting and operation of said power plant, and a main hydraulic pump with variable displacement, mechanically driven by said power plant, and which is, in-turn, connected to a hydraulic motor in a closed hydraulic loop, and a secondary hydraulic pump, smaller than the main hydraulic pump, for pumping hydraulic fluid into a solenoid control manifold, and a sheave pressure roller assembly and controlling actuator to bring said sheave pressure roller assembly in or out of contact with an opposing sheave roller, to effectively allow the sheave pressure roller to engage feed or disengage feed to a skidline cable, and a skyline cable clamp assembly and controlling actuator to clamp or un-clamp said carriage to a skyline cable, and a skidline cable clamp assembly and controlling actuator to clamp or un-clamp said carriage to a skidline cable, and a radio subsystem that facilitates remotely controlling said carriage, and an electronic control subsystem located within said carriage for performing of said power power plant and for performing control of said main hydraulic pump, for performing control of said sheave pressure roller actuator, for performing control of said skyline cable clamp actuator, and for performing control of said skidline cable clamp actuator, and a rotational rate sensor that is detected by said electronic control subsystem for control of said main hydraulic pump volume output.

2. The remotely controlled carriage of claim 1 that utilizes an electrically controlled, proportional output hydraulic pump.

3. The remotely controlled carriage of claim 2 that utilizes a hydraulic-pilot controlled, proportional output hydraulic pump.

4. The remotely controlled carriage of claim 1 that incorporates a swiveling hydraulic fluid pick-up tube that facilitates fluid pick-up when operating said carriage at extreme angles.

5. A remotely controlled drum carriage for movement along a suspended cable which comprises:

a chassis containing a power plant, and an electrical system which comprises a battery, electric starter and alternator for starting and operation of said power plant, and a main hydraulic pump with variable displacement, mechanically driven by said power plant, and which is, in-turn, connected to a hydraulic motor in a closed hydraulic loop, and a secondary hydraulic pump, smaller than the main hydraulic pump, for supplying pressurized hydraulic fluid to a solenoid-controlled selectective distribution manifold, and a cable drum assembly driven by said hydraulic motor, and a skyline cable clamp assembly and controlling actuator to clamp or un-clamp said carriage to a skyline cable, and a skidline cable clamp assembly and controlling actuator to clamp or un-clamp said carriage to a skidline cable, and a radio control system that facilitates remotely controlling said carriage, and an electronic control system for performing control of said power plant and for performing control of said main hydraulic pump, and for performing control of said said skyline cable clamp actuator, and for performing control of said skidline cable clamp actuator, and a rotational rate sensor that is detected by said electronic control system for control of said main hydraulic pump volume output.

6. The remotely controlled carriage of claim 5 that utilizes an electrically controlled, proportional output hydraulic pump.

7. The remotely controlled carriage of claim 5 that utilizes a hydraulic-pilot controlled, proportional output hydraulic pump.

8. The remotely controlled carriage of claim 5 that incorporates a swiveling hydraulic fluid pick-up tube that facilitates fluid pick-up when operating said carriage at extreme angles.

* * * * *